US005316888A

United States Patent [19]

Naruse et al.

[11] Patent Number: 5,316,888

[45] Date of Patent: May 31, 1994

[54] COLOR DIFFUSION TRANSFER PHOTOGRAPHIC FILM UNIT

[75] Inventors: Hiedaki Naruse; Jiro Tsukahara, both of Kanagawa, Japan

[73] Assignee: Fuji Photo Film Co., Ltd., Kanagawa, Japan

[21] Appl. No.: 49,392

[22] Filed: Apr. 21, 1993

[30] Foreign Application Priority Data

Apr. 22, 1992 [JP] Japan ..... 4-127904

[51] Int. Cl.[5] ..... G03C 5/54

[52] U.S. Cl. ..... 430/216; 430/212; 430/218; 430/215; 430/220; 430/551

[58] Field of Search ..... 430/203, 214, 216, 218, 430/200, 201, 220, 212, 551

[56] References Cited

U.S. PATENT DOCUMENTS

| | | | |
|---|---|---|---|
| 4,499,174 | 2/1985 | Bishop et al. | 430/220 |
| 4,728,595 | 3/1988 | Hayashi et al. | 430/220 |
| 4,968,598 | 11/1990 | Nakamura et al. | 430/214 |
| 5,190,853 | 3/1993 | Seto et al. | 430/551 |
| 5,254,433 | 10/1993 | Nakamura et al. | 430/216 |

OTHER PUBLICATIONS

"Photographic Processes and Products" *Research Disclosure* No. 15162, Nov. 1976, pp. 76–87.

"Color of Diffusion Transfer Photographic Material", *Research Disclosure* No. 16741, Mar. 1979, pp. 32 and 33.

*Primary Examiner*—Charles L. Bowers, Jr.

*Attorney, Agent, or Firm*—Sughrue, Mion, Zinn, Macpeak & Seas

[57] ABSTRACT

Disclosed is a color diffusion transfer photographic film unit improved in separability and light fastness. It comprises (1) a light sensitive sheet having an image receiving layer, a white reflective layer, a shading layer and at least one silver halide emulsion layer having at least one dye image forming substance, which layers are formed on a transparent support, (2) a transparent cover sheet comprising a neutralization layer and a neutralization timing layer, which layers are formed on a transparent support, and (3) a shading alkali treating composition developed between the light sensitive sheet and the transparent cover sheet. Further, the image receiving layer contains a hydrazine derivative represented by the following general formula (I):

(I)

wherein $R_1$, $R_2$, $R_3$ and $R_4$ each independently represent a substituted or unsubstituted alkyl, cycloalkyl, alkenyl or aralkyl group and may combine with one another to form a ring, provided that this ring is a non-aromatic heterocyclic group and that all atoms belonging to $R_1$, $R_2$, $R_3$ and $R_4$ and constituting the ring are carbon atoms.

3 Claims, No Drawings

COLOR DIFFUSION TRANSFER PHOTOGRAPHIC FILM UNIT

FIELD OF THE INVENTION

The present invention relates to a color diffusion transfer photographic material which is improved in filing suitability (i.e., easy storage of the photographic material when mounted) by enabling an image receiving portion to be separated after processing and which is significantly improved in light fastness.

BACKGROUND OF THE INVENTION

Mono-sheet type diffusion transfer photographic materials are well known in many literature references such as *Research Disclosure,* Vol. 151, No. 15162 (1976) and *Photographic Science and Engineering,* Vol. 20, No. 4 (1976).

However, mono-sheet type photographic materials are very inconvenient to mount and file because of their considerable thickness, as photographic prints after processing.

In order to avoid this inconvenience, a method of providing a separation layer such as a hydroxyethyl cellulose layer between hydrophilic layers is disclosed in JP-A-59-220727 (the term "JP-A" as used herein means an "unexamined published Japanese patent application"), and a method of dividing a white pigment layer formed of a light reflective organic polymer into two layers is disclosed in JP-A-61-165755.

However, these methods raise the problem that light fading takes place, regardless of separation, even though separation ability and filing suitability are improved.

On the other hand, as means for preventing this fading, various antifading agents are disclosed in JP-A-57-68833, JP-A-60-130735, JP-A-61-118748 and JP-A-61-159644. However, even the use of these antifading agents does not provide a sufficient improvement in light fading. In this regard, a technique for improving light fastness and imparting filing suitability has been desired.

SUMMARY OF THE INVENTION

It is therefore an object of the present invention to provide a mono-sheet type diffusion transfer photographic material of a separation system improved in light fastness. Another object of the present invention is to provide a mono-sheet type diffusion transfer photographic material excellent in filing suitability after separation.

These and other objects can be accomplished by a color diffusion transfer photographic film unit comprising, (1) a light sensitive sheet comprising an image receiving layer, a white reflective layer, a shading layer and at least one silver halide emulsion layer having at least one dye image forming substance, which layers are formed on a transparent support, (2) a transparent cover sheet comprising a neutralization layer and a neutralization timing layer, which layers are formed on a transparent support, and (3) a shading alkali treating composition developed between the above-described light sensitive sheet and the above-described transparent cover sheet. The image receiving layer contains a hydrazine derivative represented by the following general formula (I):

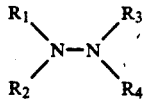

(I)

wherein $R_1$, $R_2$, $R_3$ and $R_4$ each independently represent a substituted or unsubstituted alkyl, cycloalkyl, alkenyl or aralkyl group and may combine with one another to form a ring, provided that said ring is a non-aromatic heterocyclic group and that all atoms belonging to $R_1$, $R_2$, $R_3$ and $R_4$ and constituting the ring are carbon atoms.

DETAILED DESCRIPTION OF THE INVENTION

The hydrazine derivatives represented by general formula (I) are hereinafter described in detail.

In formula (I), preferably, $R_1$, $R_2$, $R_3$ and $R_4$ each independently represent substituted or unsubstituted alkyl groups having 1 to 36 carbon atoms (e.g., methyl, ethyl, n-butyl, t-butyl, dodecyl, octadecyl, 2-ethylhexyl, 3,5,5-trimethylhexyl), substituted or unsubstituted cycloalkyl groups having 1 to 36 carbon atoms (e.g., cyclopentyl, cyclohexyl), substituted or unsubstituted alkenyl groups having 1 to 36 carbon atoms (e.g., allyl, 1-dodecene-12-yl, 2-butene-1-yl), and substituted or unsubstituted aralkyl groups having 1 to 36 carbon atoms (e.g., benzyl, 1-phenylethyl, 2-phenylethyl, 1-naphthylmethyl, 2-naphthylethyl, 9-anthrylmethyl).

Of these groups, alkyl groups having 1 to 24 carbon atoms are particularly preferred.

Substituent groups for $R_1$, $R_2$, $R_3$ and $R_4$ are alkoxy groups (e.g., methoxy, ethoxy, benzyloxy, methoxyethoxy), halogen atoms (e.g., chlorine, bromine, iodine), a hydroxyl group, aryloxy groups (e.g., phenoxy, 1-naphthyloxy), nitro groups, cyano groups, acylamino groups (e.g., acetylamino, benzoylamino, phenoxyacetylamino), sulfonamido groups (e.g., methanesulfonamido, p-toluenesulfonamido), ureido groups, alkoxycarbonyl groups (e.g., methoxycarbonyl, benzyloxycarbonyl), carbamoyl groups (e.g., carbamoyl, N-methylcarbamoyl, N,N-diphenylcarbamoyl), sulfamoyl groups (e.g., sulfamoyl, N-methylsulfamoyl, N-phenylsulfamoyl), acyl groups (e.g., acetyl, benzoyl), acyloxy groups (e.g., acetoxy, benzoyloxy), sulfonyl groups (e.g., methylsulfonyl, dodecylsulfonyl, phenylsulfonyl), sulfonic acid groups and salts thereof, carboxylic acid groups and salts thereof, amino groups, alkylamino groups (e.g., methylamino, dimethylamino, dibutylamino), anilino groups (e.g., anilino, diphenylamino, N-phenyl-N-methylamino), trialkylammomium groups (e.g., trimethylammonium, tributylammonium, dimethylhexadecylammonium, dimethylbenzylammonium) and the like.

Of these groups, the hydroxyl group, the sulfonic acid group and salts thereof, and the carboxylic acid group and salts thereof are preferred.

In general formula (I), $R_1$, $R_2$, $R_3$ and $R_4$ may combine with one another to form a ring, provided that this ring is a non-aromatic heterocyclic group and that all atoms belonging to $R_1$, $R_2$, $R_3$ and $R_4$ are constituting the ring are carbon atoms.

When $R_1$, $R_2$, $R_3$ and $R_4$ combine with one another to form rings, preferred forms are represented by the following general formulae (II) to (V):

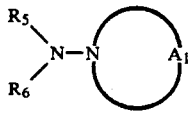
(II)

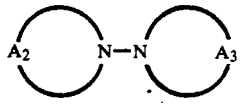
(III)

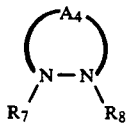
(IV)

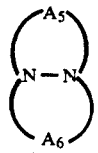
(V)

In general formulae (II) to (V), $R_5$, $R_6$, $R_7$ and $R_8$ have the same meaning as $R_1$ to $R_4$. $A_1$, $A_2$, $A_3$, $A_4$, $A_5$ and $A_6$ represent atoms necessary for forming 4-membered to 10-membered rings together with the hydrazine nitrogen atoms, provided all atoms belonging to $A_1$ to $A_6$ and constituting the 4-membered to 10-membered rings (hereinafter referred to as basic rings) are carbon atoms.

Examples of $A_1$ to $A_6$ include substituted or unsubstituted alkylene groups (e.g., ethylene, propylene, butylene, pentylene, hexylene, heptylene, octylene, nonylene).

$A_1$ to $A_6$ may contain alkyl groups, cycloalkyl groups, aralkyl groups, aryl groups as those defined in $R_1$ to $R_4$ and the substituent groups for $R_1$ to $R_4$ described above, as substituent groups to the basic rings. Further, other rings may be condensed with the basic rings to form bicyclo rings. In this case, the rings which can be condensed with the basic rings may be either alicyclic or aromatic rings. In the case of the aromatic rings, however, the aromatic rings should not be directly bonded to the hydrazine nitrogen atoms constituting the basic rings.

Specific examples of the hydrazine derivatives used in the present invention are shown below, but are not limited thereto:

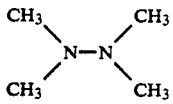
(1)

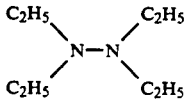
(2)

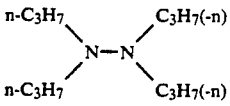
(3)

-continued

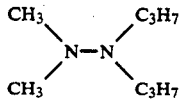
(4)

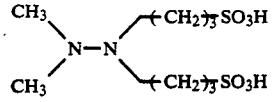
(5)

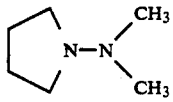
(6)

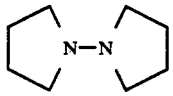
(7)

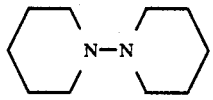
(8)

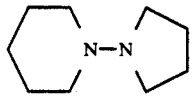
(9)

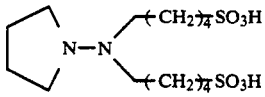
(10)

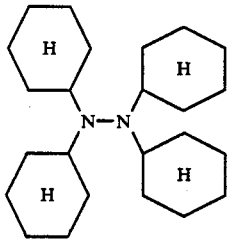
(11)

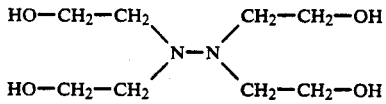
(12)

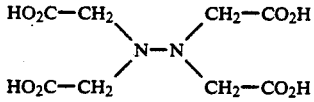
(13)

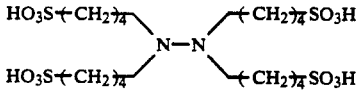
(14)

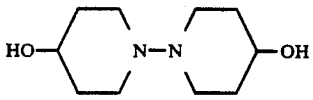
(15)

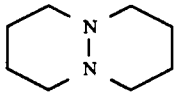
(16)

-continued (17)

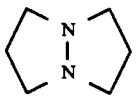

(18)

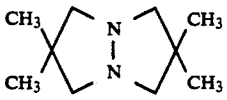

(19)

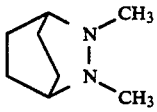

(20)

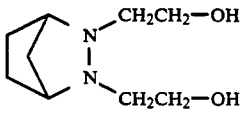

(21)

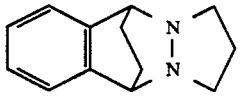

(22)

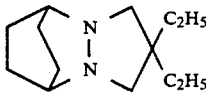

(23)

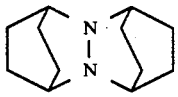

(24)

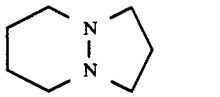

(25)

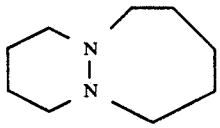

(26)

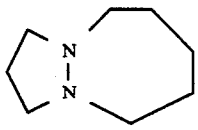

(27)

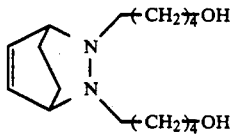

(28)

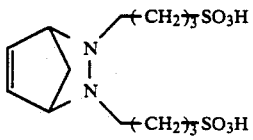

-continued (29)

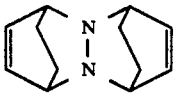

(30)

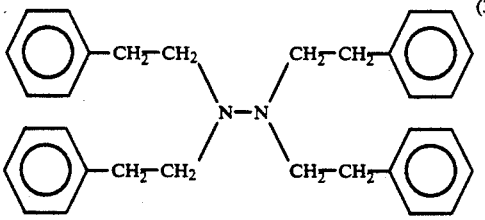

(31)

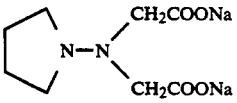

(32)

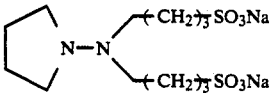

(33)

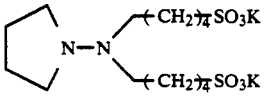

(34)

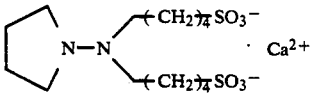

(35)

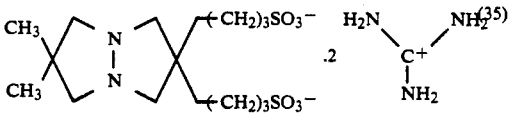

The hydrazine derivatives used in the present invention can be synthesized by successive alkylation of hydrazine hydrate. Alkylation methods include direct alkylation methods using alkyl halides or alkyl sulfonates, reductive alkylation methods using carbonyl compounds and sodium cyanoboron hydride, and methods in which reduction is conducted using lithium aluminum hydride after alkylation. These methods are described in detail, for example, in *J. Am. Chem. Soc.*, 98, 5275, and ibid., 112, 5084.

Synthesis examples of the hydrazine derivatives used in the present invention are shown below.

SYNTHESIS EXAMPLE 1

Synthesis of Example Compound (6)

1-1. Synthesis of N-Dimethylaminosuccinimide

Forty grams of succinic anhydride was mixed with 200 cc of acetic acid, and 25 g of N-dimethylhydrazine was added thereto, followed by heating under reflux for 2 hours. The reaction solution was poured into ice water, and then the resulting solution was made weakly basic by a 5% aqueous solution of sodium hydroxide, followed by extraction with chloroform. After the chloroform phase was dried with magnesium sulfate, the solvent was removed by distillation. A 1:1 mixture of ethyl acetate and hexane was added to the residue, and the mixture was gently stirred to precipitate 26 g of desired crystals. The yield was 44%.

1-2. Synthesis of N-Dimethylaminopyrrolidine

Twenty-seven grams of lithium aluminum hydride was mixed with 300 ml of tetrahydrofuran and stirred at 0° C. A solution of 200 g of N-dimethylaminosuccinimide synthesized above in 100 cc of tetrahydrofuran was added dropwise thereto for 20 minutes. To the reaction solution, 30 cc of a 15% aqueous solution of sodium hydroxide was added, followed by careful addition of 70 ml of water. The crystals were separated by filtration, and the filtrate was extracted with methylene chloride. The extract was dried and concentrated to obtain 1.5 g of a desired oily product. The yield was 9%.

SYNTHESIS EXAMPLE 2

Synthesis of Example Compound (18)

2-1. Synthesis of 1,2-Bis-(1-chloro-2,2-dimethylpropionyl)hydrazine

Sixteen grams of hydrazine hydrate was mixed with 300 ml of water, and 200 g of ice was added thereto, followed by stirring. Then, 100 g of chloropivaloyl chloride was slowly added dropwise thereto. With the progress of the reaction, a solid precipitated. After the completion of the reaction, 200 ml of methanol, 100 ml of water and 500 ml of ethyl acetate were added, and a desired product was extracted with ethyl acetate. After the organic phase was dried with magnesium sulfate, the solvent was removed by distillation under reduced pressure. Water was added to the residue to crystallize, and 81 g of crystals were collected by filtration. The yield was 94.0% and the melting point of the crystals was 206 to 207° C.

2-2. Synthesis of 1,5-Diaza-2,6-dioxo-3,3,7,7-tetramethylbicyclo[3,3,-0]octane

Eighty grams of the product synthesized in 2-1 was dissolved in 200 ml of methanol, and 200 ml of a 28% solution of sodium methoxide in methanol was added thereto. After heating under reflux for 5 hours, methanol was removed by distillation under reduced pressure. To the residue, 200 ml of methanol was added, and solid materials were separated by filtration. The filtrate was concentrated, and then purified by column chromatography using Sephadex LH-20 as a carrier and methanol as an eluent. Upon recrystallization from water, 21 g of a desired product was obtained. The yield was 36.0% and the melting point of the product was 164 to 167° C.

2-3. Synthesis of 1,5-Diaza-3,3,7,7-tetramethylbicyclo[3,3,0]octane

Seventeen grams of the compound synthesized in 2-2 was dissolved in 200 ml of tetrahydrofuran, and 7 g of lithium aluminum hydride was added thereto little by little. After heating under reflux for 6 hours, the reaction solution was poured into ice water. The resulting solution was made basic with sodium hydroxide, followed by extraction with 300 ml of ethyl acetate. For the organic phase, the solvent was removed by distillation, followed by purification by column chromatography using alumina as a carrier. Fractions of a desired product were collected and concentrated. The concentrate was dissolved in ethyl acetate, and 10 g of oxalic anhydride was added thereto to dissolve it by heating. Upon cooling, crystals precipitated. The crystals were filtered to obtain 4.5 g of an oxalate of a desired product. The yield was 20.1%.

This oxalate was dissolved in methanol, and excess $NaHCO_3$ was added thereto for neutralization. Solid materials were removed by filtration, and the filtrate was concentrated under reduced pressure to obtain the desired product, which was an oily substance.

In some cases, the hydrazine derivatives used in the present invention are advantageously synthesized by isolating them as salts thereof. There is no trouble in isolation as the salts. Preferred examples of the salts in such cases include oxalates, hydrogenoxalates, hydrochlorides, sulfates, sulfites, nitrates, organic sulfonates, organic carboxylates, phosphates, carbonates and bicarbonates.

The layers to which the hydrazine derivative is added are described below.

The hydrazine derivative is desirably added to an image receiving layer described below, but may be added to other layers as desired.

It is desirable that the hydrazine derivative used in the present invention is contained in the above-described image receiving layer after image formation. For example, the hydrazine derivative may be transferred together with a dye during image formation processing or by any method (for example, immersion in an aqueous solution of the hydrazine derivative) after image formation, thereby causing the hydrazine derivative to be contained in the image receiving layer.

The image receiving layer used in the present invention comprises a mordant in a hydrophilic colloid, and may have either a monolayer structure or a multilayer structure in which mordants different from one another in mordant ability are contained. This is described in JP-A-61-252551.

Polymer mordants are preferably used. The polymer mordants are polymers having nitrogen-containing heterocyclic moieties containing secondary or tertiary amino groups or polymers containing quaternary cations. Their molecular weight is preferably 5,000 or more, and more preferably 10,000 or more.

The amount of the mordants applied is generally 0.5 to 10 g/m$^2$, preferably 1.0 to 5.0 g/m$^2$, and more preferably 2.0 to 4.0 g/m$^2$.

Examples of the hydrophilic colloids used in the image receiving layer include gelatin, polyvinyl alcohol, polyacrylamide and polyvinylpyrrolidone. Gelatin is particularly preferred among them.

The amount of the hydrazine derivative used can be suitably determined according to the kind and amount of dyes to be fixed and the kind of image formation employed. Mentioned as one measure, the amount is 0.1 to 10,000 mol % based on the total amount of dyes to be fixed, preferably 1 to 5,000 mol %, and more preferably 500 to 2,000 mol %.

In order to allow antifading effect of the hydrazine derivatives to continue for a long period of time, it is very important that the hydrazine derivative have a low volatility. For this purpose, it is preferred that the hydrazine derivative have a molecular weight of 200 or more, or have groups such as hydroxyl groups, carboxylic acid groups or the salt thereof, or sulfonic acid groups or the salts thereof.

In the present invention, known antifading agents may be used in combination. Examples of the known antifading agents include antioxidants, ultraviolet light absorbers and some kinds of metal complexes.

Examples of the antioxidants include chroman compounds, coumaran compounds, phenol compounds (for example, hindered phenols), hydroquinone derivatives, hindered amine derivatives and spiroindane compounds. Compounds described in JP-A-61-159644 are also effective.

Examples of the ultraviolet light absorbers include benzotriazole compounds (U.S. Pat. No. 3,533,794, etc.), 4-thiazolidone compounds (U.S. Pat. No. 3,352,681, etc.), benzophenone compounds (JP-A-46-2784, etc.), and other compounds described in JP-A-54-48535, JP-A 62-136641, JP-A-61-88256, etc. Ultraviolet light absorbing polymers described in JP-A-62-260152 are also effective.

Examples of the metal complexes include compounds described in U.S. Pat. No. 4,241,155, U.S. Pat. No. 4,245,018 (columns 3 to 36), U.S. Pat. No. 4,254,195 (columns 3 to 8), JP-A-62-174741, JP-A-61-88256 (pages 27 to 29), JP-A-1-75568 and JP-A-63-199248.

Useful examples of the antifading agents are described in JP-A-62-215272, pages 125 to 137.

These antifading agents may be either previously added to image receiving elements (particularly, the image receiving layer) or supplied thereto from the outside, such as from light sensitive elements.

The above-described antioxidants, ultraviolet light absorbers and metal complexes may be used in combination with one another.

A separation layer used in the present invention is hereinafter described.

The separation layer used in the present invention can be formed in any part of the light sensitive sheet in the unit after processing. Examples of materials for separation which can be used are described in JP-A-47-8237, JP-A-59-220727, JP-A-49-4653, U.S. Pat. Nos. 3,220,835 and 4,359,518, JP-A-49-4334, JP-A-56-65133, JP-A-45-24075, U.S. Pat. Nos. 3,227,550, 2,759,825, 4,401,746 and 4,366,227. Specifically, water-soluble (or alkali-soluble) cellulose derivatives are used. Examples of the cellulose derivatives include hydroxyethyl cellulose, cellulose acetate phthalate, plasticized methyl cellulose, ethyl cellulose, cellulose nitrate and carboxymethyl cellulose. Such materials for separation further include various natural polymers such as alginic acid, pectin and gum arabic; various modified gelatin such as acetylated gelatin and phthalated gelatin; and synthetic polymers such as polyvinyl alcohol, polyacrylate, polymethyl methacrylate and copolymers thereof.

Of these, the cellulose derivatives are preferably used as the materials for separation, and hydroxyethyl cellulose is particularly preferred.

In addition to the water-soluble cellulose derivatives, granular materials of organic polymers may be used as the materials for separation.

Examples of the organic polymers used in the present invention include polymer latexes of polyethylene, polystyrene, polymethyl methacrylate, polyvinylpyrrolidone, polybutyl acrylate, etc., each having an average particle size of 0.01 to 10 μm. In this invention, however, a light reflective hollow polymer latex is preferably used which comprises hollow polymer particles composed of an organic polymer and containing air inside.

The above-described light reflective hollow polymer latex can be synthesized by the method described in JP-A-61-151646.

Specific examples of the organic polymers include polymers of the following compounds:

(1) Acrylates (for example, methyl acrylate, ethyl acrylate, isopropyl acrylate, n-butyl acrylate, octyl acrylate, 2-chloroethyl acrylate, 2-cyanoethyl acrylate, N-(β-dimethylaminoethyl) acrylate, benzyl acrylate, cyclohexyl acrylate and phenyl acrylate);

(2) Methacrylates (for example, methyl methacrylate, ethyl methacrylate, isopropyl methacrylate, n-butyl methacrylate, cyclohexyl methacrylate and 3-sulfopropyl methacrylate);

(3) Vinyl ethers (for example, methyl vinyl ether, butyl vinyl ether, methoxyethyl vinyl ether, 2-hydroxyethyl vinyl ether, (2-dimethylaminoethyl) vinyl ether, vinyl phenyl ether and vinyl chlorophenyl ether);

(4) Acrylamides (for example, acrylamide, N-methylacrylamide, N-(1,1-dimethyl-3-oxobutyl)acrylamide, N-(1,1-dimethyl-3-hydroxybutyl)acrylamide, N,N-dimethylacrylamide, acryloylhydrazine and N-hydroxymethylacrylamide);

(5) Methacrylic amides (for example, methacrylic amide, N-methoxymethylmethacrylamide and N-(1,1-di-methyl-3-hydroxybutyl)methacrylamide);

(6) Vinyl heterocyclic compounds (for example, vinylpyridine, N-vinylimidazole, N-vinylcarbazole and vinylthiophene);

(7) Styrenes (for example, styrene, chloromethylstyrene, p-acetoxystyrene and p-methylstyrene);

(8) Vinyl esters (for example, p-vinylbenzoic acid and methyl p-vinylbenzoate);

(9) Vinyl ketones (for example, methyl vinyl ketone and phenyl vinyl ketone);

(10) Crotonates (for example, butyl crotonate and glycerol monocrotonate);

(11) Itaconates (for example, butyl itaconate and glycerol monoitaconate);

(12) Maleates (for example, ethyl maleate, butyl maleate and octyl fumarate);

(13) Unsaturated nitriles (for example, acrylonitrile and methacrylonitrile); and

(14) Olefins (including halogenated olefins; for example, ethylene, propylene, 1-butene and vinylidene chlorides).

In case of a copolymer latex, there is no limitation on the ratio (i.e., molar ratio) of copolymers used, and the ratio can be suitably selected.

Further, it is preferred that these organic polymers are those having no film forming property. Such polymers can be used in combination with binders such as gelatin, derivatives thereof, polyvinyl alcohol, hydroxyethyl cellulose, carboxymethyl cellulose and polyvinylpyrrolidone, at any ratio.

Each of the separation layers prepared using these polymers may be composed of a single layer or a plurality of layers described, for example, in JP A-59-220727 and JP-A-60-60642.

The layer constitution of the present invention provides on the support, the image receiving layer, the white reflective layer, the opaque layer, the separation layer and the light sensitive layer in this order, or the image receiving layer, the white reflective layer, the separation layer, the opaque layer and the light sensitive layer in this order.

The other constituent elements are hereinafter be described.

I. LIGHT SENSITIVE SHEET

A) Support

For the support of the light sensitive sheet used in the present invention, any support may be used as long as it is a smooth transparent support. The support may be formed of cellulose acetate, polystyrene, polyethylene terephthalate or polycarbonate, and preferably provided with an undercoat. It is usually preferred that the support contain a dye or a pigment such as titanium oxide in slight amounts to prevent light piping.

The thickness of the support is 50 to 350 μm, preferably 70 to 210 μm, and more preferably 80 to 150 μm.

A curl balancing layer or an oxygen shielding layer described in JP-A-56-78833 may be formed on the back side of the support as desired.

B) Image Receiving Layer

The image receiving layer used in the present invention contains a mordant in a hydrophilic colloid. The layer may have either a monolayer structure or a multilayer structure in which mordants which are different from one another in mordant ability are contained. This is described in JP-A-61-252551.

The polymer mordants are preferably used. The polymer mordants are polymers having nitrogen-containing heterocyclic moieties containing secondary or tertiary amino groups or polymers containing quaternary cations. Their molecular weight is preferably 5,000 or more, and more preferably 10,000 or more.

The amount of the mordants applied is generally 0.5 to 10 g/m$^2$, preferably 1.0 to 5.0 g/m$^2$, and more preferably 2.0 to 4.0 g/m$^2$.

Examples of the hydrophilic colloids used in the image receiving layer include gelatin, polyvinyl alcohol, polyacrylamide and polyvinylpyrrolidone.

C) White Reflective Layer

The white reflective layer forming the white background of a color image usually comprises a white pigment and a hydrophilic binder. The white pigments used for the white reflective layer include barium sulfate, zinc oxide, barium stearate, silver flakes, silicates, alumina, zirconium oxide, sodium zirconium sulfate, kaolin, mica and titanium dioxide. In addition, non-film forming polymer particles formed of polystyrene or the like may be used. These may be used alone or in combination within the range giving a desired reflectance.

As the white pigment, titanium dioxide is particularly useful.

The whiteness of the white reflective layer varies depending on the kind of pigment, the pigment-binder mixture ratio and the amount of the pigment applied. It is, however, desirable that the light reflectance is 70% or more. In general, the whiteness increases with an increase in the amount of the pigment applied. However, when the image forming dye diffuses through this layer, the diffusion of the dye is resisted by the pigment. It is therefore desirable to apply the pigment in suitable amounts.

It is preferred that titanium dioxide be applied in an amount of 5 to 40 g/m$^2$, preferably 10 to 25 g/m$^2$, to give a white reflective layer having a light reflectance of 78 to 85% at a wavelength of 540 mm.

Titanium dioxide can be selected from among various commercial brands.

In particular, rutile type titanium dioxide is preferably used among others. Many of the commercial products are surface treated with alumina, silica, zinc oxide or the like. In order to obtain a high reflectance, it is desirable that the titanium dioxide has at least 5% of the surface treated material. Commercially available titanium dioxide includes, for example, products described in *Research Disclosure,* No. 15162, as well as Ti-pure R931 (Du Pont).

The binders suitable for the white reflective layer include alkali-permeable high polymer matrixes, for example, gelatin, polyvinyl alcohol and cellulose derivatives such as hydroxyethyl cellulose and carboxymethyl cellulose. Of these, gelatin is particularly desirable.

The white pigment-gelatin ratio is 1/1 to 20/1 (by weight), and preferably 5/1 to 10/1 (by weight).

It is preferred that the antifading agents described in JP-B-62-30620 (the term "JP-B" as used herein means an "examined Japanese patent publication") and JP-B-62-30621 are incorporated into the white reflective layer.

D) Shading Layer (Opaque Layer)

The shading layer containing a shading agent and a hydrophilic binder is provided between the white reflective layer and the light sensitive layer.

As the shading agent, any material may be used as long as it preforms a shading function. In particular, carbon black is preferably used. The decomposable dyes described in U.S. Pat. No. 4,615,966 may also be used.

As the binder for applying the shading agent, any material may be used as long as it can disperse carbon black. Gelatin is preferably used.

Carbon black materials which can be used include carbon black produced by any method such as the channel method, the thermal method and the furnace method, for example, as described in Donnel Voet, Carbon Black, Marcel Dekker Inc. (1976). There is no particular limitation on the particle size of carbon black, but the particle size is preferably 90 to 1,800 Å. The amount of a black pigment added as the shading agent may be adjusted depending on the sensitivity of the photographic material to be shaded. The optical density is preferably adjusted to about 5 to 10.

E) Light Sensitive Layer

In the present invention, the light sensitive layer comprising a silver halide emulsion layer combined with a dye image forming substance is formed on the above-described shading layer. The constituent elements thereof are described below.

(1) Dye Image Forming Substance

The dye image forming substances used in the present invention are non-diffusible compounds releasing diffusible dyes (or dye precursors) with respect to silver development or compounds whose diffusibility varies, which are described in *The Theory of the Photographic Process,* the fourth edition. These compounds are all represented by the following general formula

DYE-Y wherein DYE represents a dye or a dye precursor, and Y represents a component giving a compound which is different from the compound represented by the above-described general formula in diffusibility under alkaline conditions. Based on the function of Y, these compounds are roughly divided into negative type compounds which become diffusible in silver-developed portions and positive type compounds which become diffusible in undeveloped portions.

Specific examples of the negative type Y components include components which are oxidized as a result of development and cleaved to release diffusible dyes.

Specific examples of the Y components are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,378,750, 4,139,379, 4,218,368, 3,421,964, 4,199,355, 4,199,354, 4,135,929, 4,336,322 and 4,139,389, JP-A 53-50736, JP A-51 104343, JP-A 54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342 and JP-A-57-119345.

Of the Y components of the negative type dye releasing redox compounds, particularly preferred groups include N-substituted sulfamoyl groups (wherein N-substituted groups are groups derived from aromatic hydrocarbon rings or hetero rings). Typical examples of the Y groups are shown below, but they are not limited thereto.

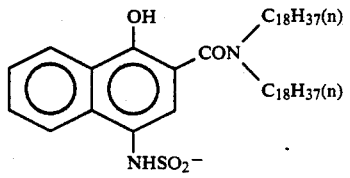

(Y-1)

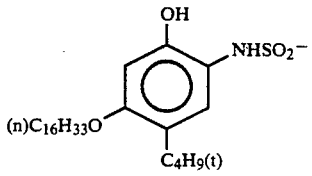

(Y-2)

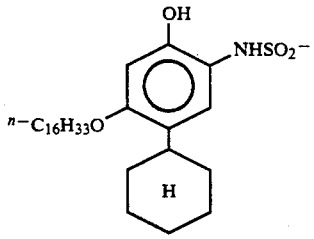

(Y-3)

-continued

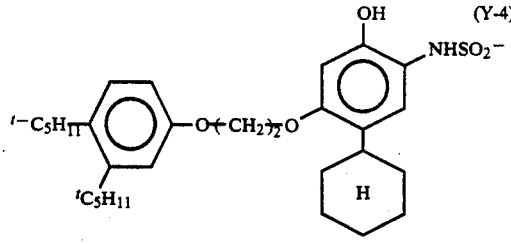

(Y-4)

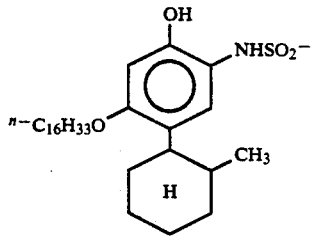

(Y-5)

The positive type compounds are described in *Angev. Chem. Inst. Ed. Engl.*, 22, 191 (1982).

Specific examples thereof include compounds (i.e., dye developing agents) which are at first diffusible under alkaline conditions, but oxidized by development to become non-diffusible. Typical Y components effective for the compounds of this type are disclosed in U.S. Pat. No. 2,983,606.

Further, the positive type compounds include compounds of another type which release diffusible dyes by self-cyclization, etc., under alkaline conditions, but substantially cease to release the dyes upon oxidation by development. Specific examples of Y components having such a function are described in U.S. Pat. No. 3,980,479, JP-A-53-69033, JP-A-54-130927, U.S. Pat. Nos. 3,421,964 and 4,199,355.

Furthermore, the positive type compounds include compounds of a further type which do not themselves release dyes, but release dyes upon reduction. The compounds of this type are used in combination with electron donors and can release the diffusible dyes imagewise by reaction with the remainder of the electron donors oxidized imagewise by silver development. Atomic groups having such a function are described, for example, in U.S. Pat. Nos. 4,183,753, 4,142,891, 4,278,750, 4,139,379 and 4,218,368, JP-A-53-110827, U.S. Pat. Nos. 4,278,750, 4,356,249 and 4,358,525, JP-A-53-110827, JP-A-54-130927, JP-A-56-164342, Kokai Giho (Japanese Published Technical Report) 87-6199 and EP-A2-220746.

Specific examples thereof are shown below, but they are not limited thereto.

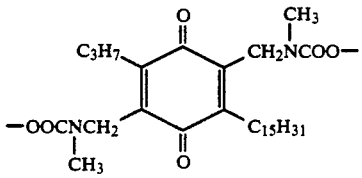

(Y-6)

-continued (Y-7)

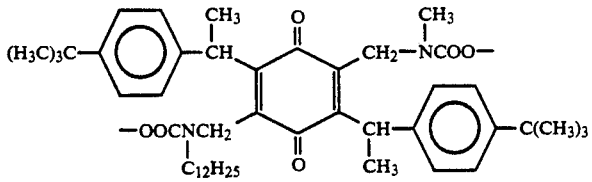

(Y-8)

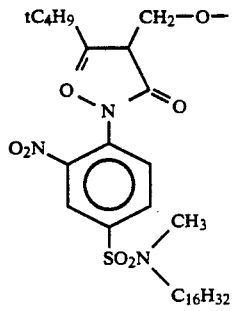

(Y-9)

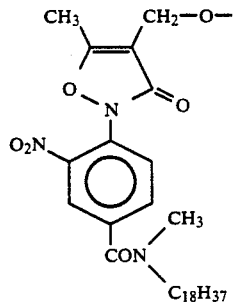

When the compounds of this type are used, they are preferably used in combination with anti-diffusible electron donor compounds (which are well known as ED compounds) or precursors thereof. Examples of the ED compounds are described, for example, in U.S. Pat. Nos. 4,263,393 and 4,278,750 and JP-A-56-138736.

Moreover, as specific examples of dye image forming substances of still another type, the following compounds can also be used:

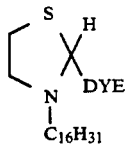

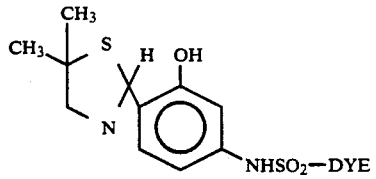

wherein DYE represents a dye or a precursor thereof having the same meaning as defined above.

Details thereof are described in U.S. Pat. Nos. 3,719,489 and 4,098,783.

Specific examples of the dyes represented by DYE of the above-described general formula are described in the following literature references:

Examples of yellow dyes:

U.S. Pat. Nos. 3,597,200, 3,309,199, 4,013,633, 4,245,028, 4,156,609, 4,139,383, 4,195,992, 4,148,641, 4,148,643 and 4,336,322, JP-A-51-114930, JP-A-56-71072, *Research Disclosure,* No. 17630 (1978) and ibid., No. 16475 (1977)

Examples of magenta dyes:

U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP A-52-106727, JP-A-53-23628, JP-A-55-36804, JP-A-73057, JP-A-56-71060 and JP-A-55-134

Examples of cyan dyes:

U.S. Pat. Nos. 3,482,972, 3,929,760, 4,013,635, 4,268,625, 4,171,220, 4,242,435, 4,142,891, 4,195,994, 4,147,544 and 4,148,642, British Patent 1,551,138, JP-A-54-99431, JP-A-52-8827, JP-A-53-47823, JP-A-53-143323, JP-A-54-99431, JP-A-56-71061, European Patents (EPC) 53,037 and 53,040, *Research Disclosure,* No. 17630 (1978) and ibid., No. 16475 (1977)

These compounds can be dispersed by the method described in JP-A-62-215272, pages 144 to 146. These dispersions may contain the compounds described in JP-A-62-215272, pages 137 to 144.

(2) Silver Halide Emulsion

The silver halide emulsions used in the present invention may be either negative type emulsions in which latent images are mainly formed on the surfaces of silver halide grains or internal latent image type direct positive emulsions in which latent images are formed inside silver halide grains.

Examples of the internal latent image type direct positive emulsions include so-called "conversion type"

emulsions which are prepared utilizing the difference in solubility of silver halides and "core/shell type" emulsions in which at least the light sensitive sites of inner core grains of silver halides doped with metal ions and/or chemically sensitized are covered with outer shells of silver halides. These are described in U.S. Pat. Nos. 2,592,250 and 3,206,313, British Patent 1,027,146, U.S. Pat. Nos. 3,761,276, 3,935,014, 3,447,927, 2,297,875, 2,563,785, 3,551,662 and 4,395,478, West German Patent 2,728,108, U.S. Pat. No. 4,431,730, etc.

Further, when the internal latent image type direct positive emulsions are used, it is necessary to give surface fogging cores by use of light or nucleating agents after imagewise exposure.

The nucleating agents used for this purpose include hydrazines described in U.S. Pat. Nos. 2,563,785 and 2,588,982; hydrazines described in U.S. Pat. Nos. 3,227,552; hydrazones; heterocyclic quaternary salt compounds described in British Patent 1,283,835, JP-A-52-69613, U.S. Pat. Nos. 3,615,615, 3,719,494, 3,734,738, 4,094,683 and 4,115,122; sensitizing dyes having substituent groups with nucleating ability in dye molecules described in U.S. Pat. No. 3,718,470; thiourea-bonding type acylhydrazine compounds described in U.S. Pat. Nos. 4,030,925, 4,031,127, 4,245,037, 4,255,511, 4,266,013 and 4,276,364 and British Patent 2,012,443; and acylhydrazine compounds having thioamido rings or heterocyclic groups such as triazole and tetrazole as absorption groups described in U.S. Pat. No. 4,080,270 and 4,278,748 and British Patent 2,011,391B.

In the present invention, color sensitizing dyes are used in combination with these negative type emulsions and internal latent image type direct positive emulsions. Specific examples thereof are described in JP-A-59-180550, JP-A-60-140335, *Research Disclosure,* No. 17029, U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470, 4,025,349, etc.

(3) Constitution of Light Sensitive Layer

For reproduction of natural colors by the subtractive color process, a light sensitive layer is used which comprises in combination the emulsion optically sensitized with the above-described color sensitizing dye and the above-described dye image forming substance for providing a dye having selective spectral absorption within the same wavelength range. The emulsion and the dye image forming substance may be either formed one over the other as different layers, or formed as one layer by mixing them. When the dye image forming substance has absorption in the optical sensitivity region of the emulsion combined therewith in its coated state, it is preferred that they are formed as the different layers. The emulsion layer may comprise a plurality of emulsion layers different in sensitivity, and any layer may be provided between the emulsion layer and the dye image forming substance layer. For example, the dye image density can be raised by providing a layer containing the nucleating development accelerator described in JP-A-60-173541 or a barrier layer described in JP-B-60-15267, or the sensitivity of the light sensitive elements can be enhanced by providing a reflective layer.

The reflective layer is a layer containing a white pigment and a hydrophilic binder. The white pigment is preferably titanium oxide and the hydrophilic binder is preferably gelatin. The amount of titanium oxide applied is 0.1 to 8 g/m$^2$, and preferably 0.2 to 4 g/m$^2$. Examples of the reflective layers are described in JP-A-60-91354.

In the preferred multilayer structure, a combined unit of blue-sensitive emulsions, a combined unit of green-sensitive emulsions and a combined unit of red-sensitive emulsions are arranged in turn from the exposure side. Any layer can be provided between the respective emulsion layer units as desired. In particular, an intermediate layer is preferably provided in order to prevent other emulsion layer units from being unfavorably affected by the development effect of a certain emulsion layer.

When a developing agent is used in combination with a non-diffusible dye image forming substance, it is preferred that the intermediate layer contains a nondiffusible reducing agent to prevent the development oxidant from diffusing. Specific examples of the reducing agents include non-diffusible hydroquinone, sulfonamidophenol and sulfonamidonaphthol. More specifically, they are described in JP-B-50-21249, JP-B-50-23813, JP-A-49-106329, JP-A-49-129535, U.S. Pat. Nos. 2,336,327, 2,360,290, 2,403,721, 2,544,640, 2,732,300, 2,782,659, 2,937,086, 3,637,393 and 3,700,453, British Patent 557,750, JP-A-57-24941, JP-A-58-21249, etc. Dispersing methods thereof are described in JP-A-60-238831 and JP-B-60-18978.

When a compound releasing the diffusible dye with silver ions as described in JP-B-55-7576 is used, it is preferred that the intermediate layer contains a compound for capturing the silver ions.

The light sensitive layers used in the present invention are provided with irradiation-preventing layers, ultraviolet light absorber layers, protective layers, etc., as desired.

II. Cover Sheet

In the present invention, a transparent cover sheet comprising layers having a neutralization function (i.e., a neutralization layer and a neutralization timing layer) is used to develop a processing solution uniformly on the light sensitive elements and to neutralize an alkali after processing to stabilize the images. The cover sheet has a dye-capturing layer as the outermost layer on the side on which the processing solution is applied.

F) Support

For the support of the cover sheet used in the present invention, any support may be used as long as it is a smooth transparent support of the type commonly used in photographic materials. The support is formed of cellulose acetate, polystyrene, polyethylene terephthalate or polycarbonate, and preferably provided with an undercoat. It is preferred that the support contain a dye in slight amounts to prevent light piping.

G) Layer Having Neutralization Function

The layer having a neutralization function used in the present invention is a layer containing an acidic material in an amount sufficient to neutralize the alkali incorporated from the processing composition. The layer may have a multilayer structure comprising layers such as a neutralization speed control layer (i.e., a timing layer) and an adhesion-enhancing layer as desired. Preferred examples of such acidic materials include materials containing an acidic group having a pKa of 9 or less (or a precursor group giving such an acidic group by hydrolysis). More preferably, the acidic materials include higher fatty acids such as oleic acid described in U.S. Pat. No. 2,983,606; polymers of acrylic acid, methacrylic acid or maleic acid, partial esters thereof or acid anhydrides thereof as disclosed in U.S. Pat. No. 3,362,819; copolymers of acrylic acid and acrylates as disclosed in French Patent 2,290,699; and latex type acidic polymers as disclosed in U.S. Pat. No. 4,139,383 and *Research Disclosure,* No. 16102 (1977).

In addition, they also include the acidic materials disclosed in U.S. Pat. No. 4,088,493, JP-A-52-153739, JP-A-53-1023, JP-A-53-4540, JP-A-53-4541 and JP-A-53-4542.

Specific examples of the acidic polymers include copolymers of maleic anhydride and vinyl monomers such as ethylene, vinyl acetate and methyl vinyl ether, copolymers of n-butyl ester thereof, butyl acrylate and acrylic acid, cellulose acetate hydrogen phthalate.

The above-described acidic polymers can be mixed with hydrophilic polymers in use. Such polymers include polyacrylamide, polymethylpyrrolidone, polyvinyl alcohol (including partially saponified products), carboxymethyl cellulose, hydroxymethyl cellulose, hydroxyethyl cellulose and polymethyl vinyl ether. Polyvinyl alcohol is preferred among them.

The above-described acidic polymers may be mixed with polymers other than the hydrophilic polymers, for example, cellulose acetate.

The amount of the acidic polymer applied is adjusted according to the amount of the alkali developed on the light sensitive elements. The equivalent ratio of the acidic polymer to the alkali per unit area is preferably 0.9 to 2.0. If the amount of the acidic polymer is too small, the hue of a transfer dye changes or stains are generated on a white ground portion. If the amount is too large, troubles such as a change in hue and a decrease in light fastness are produced. More preferably, the equivalent ratio is 1.0 to 1.3. Too large or too small an amount of the hydrophilic polymer to be mixed deteriorates the quality of a photograph. The weight ratio of the hydrophilic polymer to the acidic polymer is 0.1 to 10, and preferably 0.3 to 3.0.

For various purposes, additives may be incorporated into the layer having the neutralization function used in the present invention. For example, a hardening agent known in the art can be added to this layer to harden it, and a multivalent hydroxyl compound such as polyethylene glycol, polypropylene glycol or glycerol can be added to this layer to improve the brittleness thereof. In addition, an antioxidant, a fluorescent brightening agent, a development inhibitor or a precursor thereof can also be added as desired.

Useful polymers for the timing layers used in combination with the neutralization layers include polymers reducing alkali permeability such as gelatin, polyvinyl alcohol, partially acetalized products of polyvinyl alcohol, cellulose acetate and partially hydrolyzed polyvinyl acetate; latex polymers elevating the activation energy of alkali permeance which are produced by copolymerizing a small amount of hydrophilic comonomers such as an acrylic acid monomer; and polymers having lactone rings.

Particularly useful polymers used in the timing layers include cellulose acetate disclosed in JP-A-54-136328, U.S. Pat. Nos. 4,267,262, 4,009,030 and 4,029,849; latex polymers produced by copolymerizing a small amount of hydrophilic comonomers such as acrylic acid which are disclosed in JP-A-54-128335, JP-A-56-69629, JP-A 57-6843, U.S. Pat. Nos. 4,056,394, 4,061,496, 4,199,362, 4,250,243, 4,256,837 and 4,268,604; polymers having lactone rings disclosed in U.S. Pat. No. 4,229,516; and other polymers disclosed in JP-A-56-25735, JP-A-56-97346, JP-A-57-6842, EP-Al-31957, EP-Al-37724 and EP-Al-48412, among others.

Besides, polymers can also be used which are described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523 and 4,297,431, West German Patents (OLS) 1,622,936 and 2,162,277 and *Research Disclosure,* Vol. 151, No. 15162, (1976).

The timing layers using these polymers can be used alone or in a combination of at least two layers.

Further, for example, development inhibitors and/or their precursors disclosed in U.S. Pat. No. 4,009,029, West German Patents (OLS) 2,913,164 and 3,014,672, JP-A-54-155837 and JP-A-55-138745, or hydroquinone precursors disclosed in U.S. Pat. No. 4,201,578, or other useful photographic additives or their precursors can be incorporated into the timing layers formed of these polymers.

Furthermore, an auxiliary neutralization layer may be provided as the layer having the neutralization function as described in JP-A-63-168648 and JP-A-63-168649, whereby a change in transfer density over time after processing is decreased.

H) Others

In addition to the layer having the neutralization function, the cover sheet may have a back layer, a protective layer, a dye capture layer, a filter dye layer, etc.

The back layer is provided to control curl or to impart a slipping property. A filter dye may be added to this layer.

The protective layer is used mainly to prevent adhesion to a cover sheet back surface and adhesion to the protective layer of the photographic material when the cover sheet is superposed on the photographic material.

The dye capture layer can prevent delay of image completion time and deterioration of sharpness by capturing a dye diffused on the alkali treating composition side. Usually, a dye capture layer is formed as the outermost layer of the cover sheet. The dye capture layer contains a polymer mordant in a hydrophilic colloid as is the case with the dye image receiving layer previously described, and described in JP-A-1-198747 and JP-A-2-282253.

The cover sheet can contain a dye to adjust the sensitivity of the light sensitive layer. A filter dye may be directly added to the support of the cover sheet, the layer having the neutralization function, the back layer, the protective layer, the dye capture layer or the like, or a separate layer containing the filter dye may be formed.

III. Alkali Treating Composition

The alkali treating composition used in the present invention is uniformly developed on the light sensitive elements after exposure thereof, is provided on the back surface of the support or on the side opposite to a treating solution for the light sensitive layer to make a pair with the shading layer, thereby completely shielding the light sensitive layer from external light, and concurrently develops the light sensitive layer with the components contained therein. For this purpose, the composition contains an alkali, a thickener, a shading agent and a developing agent, and further contains a development accelerator for controlling development, a development inhibitor and an antioxidant for preventing the developing agent from deteriorating. The shading agent is necessarily contained in the composition.

The alkali is a compound which can adjust pH to 12 to 14. Examples thereof include hydroxides of alkaline metals (for example, sodium hydroxide, potassium hydroxide and lithium hydroxide), phosphates of alkaline metals (for example, potassium phosphate), guanidines and hydroxides of quaternary amines (for example, tetramethylammonium hydroxide). Potassium hydroxide and sodium hydroxide are preferred among them.

A thickener is necessary to develop the treating solution uniformly and to keep adhesion between the light sensitive layer and the cover sheet. For example, polyvinyl alcohol, hydroxyethyl cellulose and alkaline metal salts of carboxymethyl cellulose are used, and preferably, hydroxyethyl cellulose and sodium carboxymethyl cellulose are used.

As the shading agent, either a dye or a pigment or a combination thereof can be used as .long as it does not produce stains by diffusing into the dye image receiving layer. Typical examples thereof include carbon black.

As the developing agent, any can be used as long as it cross oxidizes the dye image forming substance and does not substantially produce stains when oxidized. Such developing agents may be used alone or in combination, and may be used in the form of precursors. These developing agents may be added to appropriate layers of the light sensitive elements or to alkali treating solutions. Examples thereof include aminophenols and pyrazolidinone compounds. Of these, the pyrazolidinone compounds are particularly preferred because less stain is produced.

Specific examples of such compounds include 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl 4-hydroxymethyl-3-pyrazolidinone and 1-p-tolyl-4-methyl-4-hydroxymethyl-3-pyrazolidinone.

Any of the light sensitive sheet, the cover sheet and the alkali treating composition may contain the development accelerators described in JP-A-62-215272, pages 72 to 91, hardening agents described on pages 146 to 155, surface active agents described on pages 201 to 210, fluorine-containing compounds described on pages 210 to 222, thickeners described in 225 to 227, antistatic agents described on pages 227 to 230, polymer latexes described on pages 230 to 239, matting agents described on page 240, etc.

The present invention will be further illustrated in greater detail with reference to the following examples, which are, however, not to be construed as limiting the invention.

EXAMPLE 1

A transparent support formed of a polyethylene terephthalate film having a thickness of 150 μm was coated with the layers shown in Table 1 to prepare Photographic Material 101 for comparison.

TABLE 1

Constitution of Photographic Material 101 for Comparison

| Layer No. | Layer Name | Additive | Amount Applied (g/m²) |
|---|---|---|---|
| 21st | Protective Layer | Gelatin | 1.00 |
| | | Matting Agent (1) | 0.25 |
| 20th | Ultraviolet Light | Gelatin | 0.50 |
| | | Ultraviolet Light Absorber (1) | $4.0 \times 10^{-4}$ |
| | | Ultraviolet Light Absorber (2) | |
| 19th | Yellow-Sensitive Layer (high sensitivity) | Internal Latent Image Type Direct Positive Emulsion (particle size: 1.7 μm, octahedral) | 0.60 (as silver) |
| | | Sensitizing Dye (3) | $1.4 \times 10^{-3}$ |
| | | Nucleating Agent (1) | $6.8 \times 10^{-8}$ |
| | | Additive (2) | 0.03 |
| | | Gelatin | 0.70 |
| 18th | Yellow-Sensitive Layer (high sensitivity) | Internal Latent Image Type Direct Positive Emulsion (particle size: 1.1 μm, octahedral) | 0.25 (as silver) |
| | | Sensitizing Dye (3) | $9.0 \times 10^{-4}$ |
| | | Nucleating Agent (1) | $8.0 \times 10^{-8}$ |
| | | Additive (2) | $4.5 \times 10^{-2}$ |
| | | Gelatin | 0.40 |
| 17th | White Reflective Layer | Titanium Dioxide | 0.70 |
| | | Gelatin | 0.18 |
| 16th | Yellow Color Material Layer | Yellow Dye Releasing Compound (1) | 0.53 |
| | | High Boiling Organic Solvent (1) | 0.13 |
| | | Additive (1) | $1.4 \times 10^{-2}$ |
| | | Gelatin | 0.70 |
| 15th | Intermediate Layer | Gelatin | 0.30 |
| 14th | Color Mixing Preventing Layer | Additive (1) | 0.80 |
| | | Polymethyl Methacrylate | 0.80 |
| | | Gelatin | 0.45 |
| 13th | Green-Sensitive Layer (high sensitivity) | Internal Latent Image Type Direct Positive Emulsion (particle size: 1.6 μm, octahedral) | 0.80 (as silver) |
| | | Sensitizing Dye (2) | $2.1 \times 10^{-3}$ |
| | | Nucleating Agent (1) | $2.5 \times 10^{-8}$ |
| | | Additive (2) | 0.08 |
| | | Gelatin | 1.00 |
| 12th | Green-Sensitive Layer (high sensitivity) | Internal Latent Image Type Direct Positive Emulsion (particle size: 1.0 μm, octahedral) | 0.25 (as silver) |
| | | Sensitizing Dye (2) | $1.1 \times 10^{-3}$ |
| | | Nucleating Agent (1) | $4.4 \times 10^{-8}$ |
| | | Additive (2) | 0.03 |
| | | Gelatin | 0.50 |
| 11th | White Reflective Layer | Titanium Dioxide | 1.00 |
| | | Gelatin | 0.25 |
| 10th | Magenta Color Material Layer | Magenta Dye Releasing Compound (1) | 0.50 |
| | | High Boiling Organic Solvent (1) | 0.10 |
| | | Additive (1) | $9.0 \times 10^{-3}$ |
| | | Gelatin | 0.90 |
| 9th | Intermediate Layer | Gelatin | 0.30 |
| 8th | Color Mixing Preventing Layer | Additive (1) | 1.20 |
| | | Polymethyl Methacrylate | 1.20 |
| | | Gelatin | 0.70 |
| 7th | Red-Sensitive Layer (high sensitivity) | Internal Latent Image Type Direct Positive Emulsion (particle size: 1.6 μm, octahedral) | 0.50 (as silver) |
| | | Sensitizing Dye (1) | $6.2 \times 10^{-4}$ |
| | | Nucleating Agent (1) | $5.0 \times 10^{-8}$ |
| | | Additive (2) | 0.04 |

TABLE 1-continued

Constitution of Photographic Material 101 for Comparison

| Layer No. | Layer Name | Additive | Amount Applied ($g/m^2$) |
|---|---|---|---|
| | | Gelatin | 1.80 |
| 6th | Red-Sensitive Layer (high sensitivity) | Internal Latent Image Type Direct Positive Emulsion (particle size: 1.0 μm, octahedral) | 0.15 (as silver) |
| | | Sensitizing Dye (1) | $3.0 \times 10^{-4}$ |
| | | Nucleating Agent (1) | $5.0 \times 10^{-8}$ |
| | | Additive (2) | 0.02 |
| | | Gelatin | 0.40 |
| 5th | White Reflective Layer | Titanium Dioxide | 3.00 |
| | | Gelatin | 0.80 |
| 4th | Cyan | Cyan Dye Releasing | 0.50 |

TABLE 1-continued

Constitution of Photographic Material 101 for Comparison

| Layer No. | Layer Name | Additive | Amount Applied ($g/m^2$) |
|---|---|---|---|
| | Color Material Layer | Compound (1) | |
| | | High Boiling Organic Solvent (1) | 0.10 |
| | | Additive (1) | 0.10 |
| | | Gelatin | 1.0 |
| 3rd | Opaque Layer | Carbon Black | 1.70 |
| | | Gelatin | 1.70 |
| 2nd | White Reflective Layer | Titanium Dioxide | 22.00 |
| | | Gelatin | 2.75 |
| 1st | Image Receiving Layer | Polymer Mordant (1) | 3.00 |
| | | Gelatin | 3.00 |
| | Support (polyethylene terephthalate, 150 μm) | | |

Polymer Mordant (1):

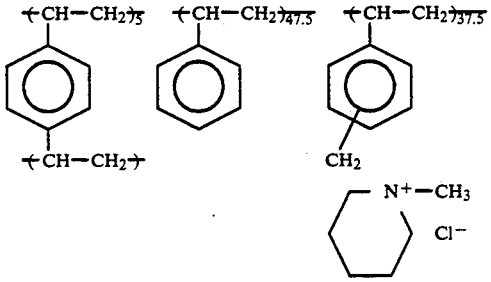

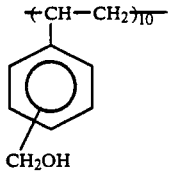

Ultraviolet Light Absorber (1):

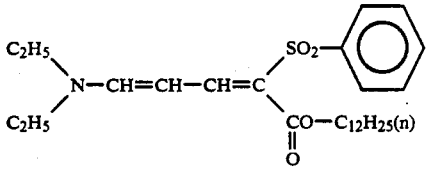

Ultraviolet Light Absorber (2):

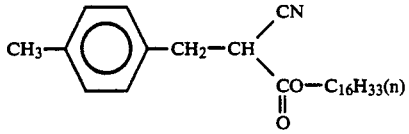

Matting Agent (1):

Spherical Latex of Polymethyl Methacrylate (average particle size: 4 μm)

Cyan Dye Releasing Compound (1):

-continued
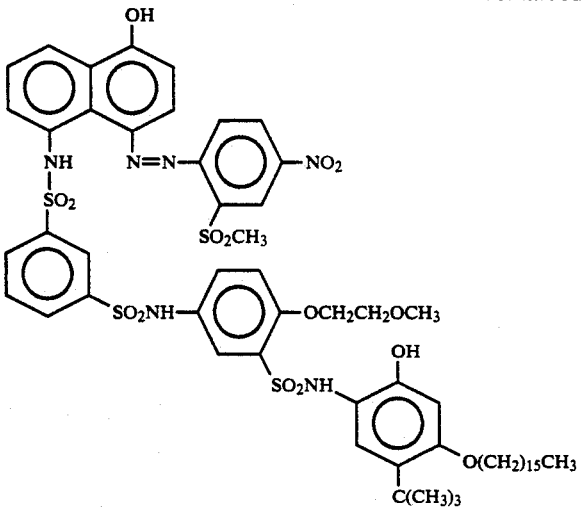
Magenta Dye Releasing Compound (1):
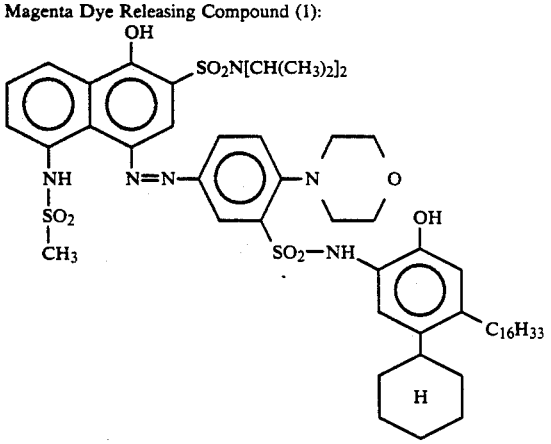
Yellow Dye Releasing Compound (1):
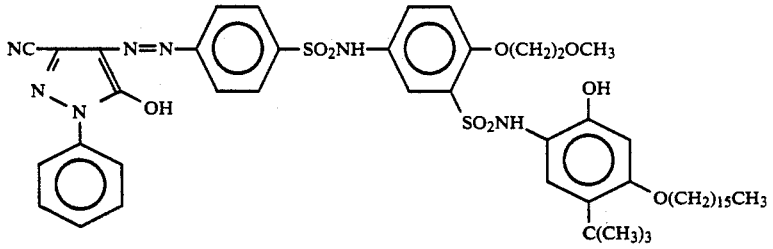
Additive (1):
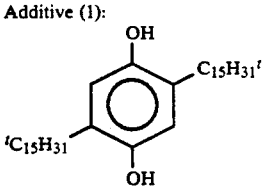
Additive (2):
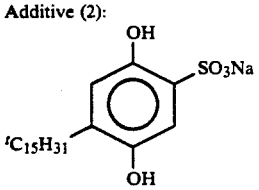
High Boiling Organic Solvent (1):
Tricyclohexyl Phosphate -continued Nucleating Agent (1):

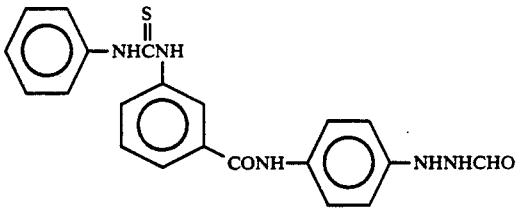

Sensitizing Dye (1):

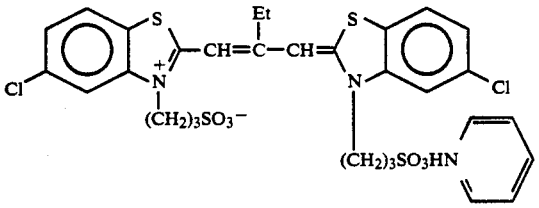

Sensitizing Dye (2):

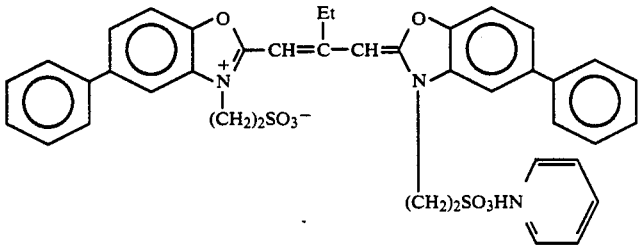

Sensitizing Dye (3):

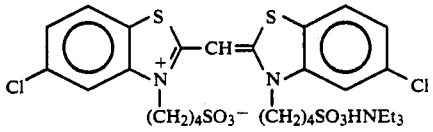

Photographic Materials 102 and 103 were prepared in the same manner as Photographic Material 101, except that the first to third layers were replaced with the layers shown in Tables 2 and 3, respectively. Further, photographic materials were prepared in the same manner as Photographic Material 101, except that hydrazine derivatives shown in Table 4 were added to the first layers (the image receiving layers) so as to give an applied amount of 3.00 g/m$^2$.

TABLE 2

| Layer No. | Layer Name | Additive | Amount Applied (g/m$^2$) |
|---|---|---|---|
| | The 4th to 21st layers of Photographic Material 101 | | |
| 6th | Opaque Layer | Carbon Black | 0.85 |
| | | Gelatin | 0.85 |
| 5th | Separation Layer | Hydroxyethyl Cellulose* | 0.50 |
| 4th | Gelatin Layer | Gelatin | 0.50 |
| 3rd | Opaque Layer | Carbon Black | 0.85 |
| | | Gelatin | 0.85 |
| 2nd | White Reflective Layer | Titanium Dioxide | 22.00 |
| | | Gelatin | 2.75 |
| 1st | Image Receiving Layer | Polymer Mordant (1) | 3.00 |
| | | Gelatin | 3.00 |

TABLE 2-continued

| Layer No. | Layer Name | Additive | Amount Applied (g/m$^2$) |
|---|---|---|---|
| | Support (polyethylene terephthalate, 150 μm) | | |

*SP500 manufactured by Daicel Chemical Industries, Ltd.

TABLE 3

| Layer No. | Layer Name | Additive | Amount Applied (g/m$^2$) |
|---|---|---|---|
| | The 4th to 21st layers of Photographic Material 101 | | |
| 4th | Opaque Layer | Carbon Black | 1.70 |
| | | Gelatin | 1.70 |
| 3rd | Separation Layer | Acryl/Styrene Copolymer (OP-84J, Rohm & Haas, Japan, K.K.) | 2.40 |
| | | Gelatin | 0.24 |
| 2nd | White Reflective Layer | Titanium Dioxide | 22.00 |
| | | Gelatin | 2.75 |
| 1st | Image Receiving Layer | Polymer Mordant (1) | 3.00 |
| | | Gelatin | 3.00 |
| | Support (polyethylene terephthalate, 150 μm) | | |

A cover sheet was prepared in the following manner.

A transparent polyethylene terephthalate support having a gelatin undercoat and containing a light piping preventing dye was coated with the following layers:

(1) a neutralization layer containing 10.4 g/m$^2$ of an acrylic acid-butyl acrylate copolymer (molar ratio 8:2) having an average molecular weight of 50,000 and 0.1 g/m$^2$ of 1,4-bis(2,3-epoxypropoxy)-butane, (2) a neutralization timing layer containing 4.3 g/m$^2$ of acetylcellulose having an acetylation degree of 51% and 0.2 g/m$^2$ of poly(methyl vinyl ether-co-monomethylmaleate), (3) a layer containing a mixture of a polymer latex obtained by emulsion polymerization of styrene/ butyl acrylate/acrylic acid/N-methylolacrylamide in a weight ratio of 49.7/42.3/4/4 and a polymer latex obtained by emulsion polymerization of methyl methacrylate/acrylic acid/N-methylolacrylamide in a weight ratio of 93/3/4 so as to give a total solid content of 2.5 g/m$^2$, and (4) a layer containing 1 g/m$^2$ of gelatin.

The formulation of an alkali treating composition is shown below:

| | |
|---|---|
| 1-p-Tolyl-4-hydroxymethyl-4-methyl-3-pyrazolidone | 10.0 g |
| Methylhydroquinone | 0.18 g |
| 5-Methylbenzotriazole | 3.0 g |
| Sodium Sulfite (Anhydrous) | 0.2 g |
| Benzyl Alcohol | 1.5 cc |
| Carboxymethyl Cellulose Na Salt | 58 g |
| Carbon Black | 150 g |
| Potassium Hydroxide (28% Aqueous Solution) | 200 cc |
| Water | 680 cc |

"A pressure-rupturable container" was filled with 0.8 g of a treating solution having the above-described composition.

After exposure from the emulsion layer side through a gray filter, the above-described photographic material was overlapped with the above-described cover sheet, and the above-described treating solution was developed between both materials to a thickness of 75 μm using a pressure roll at 25° C.

The light fastness test was carried out in the following manner. The photographic material treated by the method described above was allowed to stand at 25° C. at 60% RH for one day, and thereafter, the reflective density portion was measured with an X-Rite 310 type densitometer.

At this time, a set of a sample in which the cover sheet was separated and a sample in which the cover sheet was not separated were prepared for each photographic material. These samples were allowed to stand in a fade-o-meter equipped with a 17,000-lux fluorescent lamp for 2 weeks, and similarly measured again to determine the residual rate of the portion having a density of 1.0 before light irradiation.

Further, the separability was evaluated by the percentage of the area of the remaining parts on the separated layer (the image receiving side), when separated. In this evaluation, 100% means no remaining on the separated layer (the image receiving side).

Results of both the light fastness and the separability tests are shown in Table 4.

TABLE 4

| Photographic Material | Layer Constitution*2) | Hydrazine Compound | Light Fastness*1) (%) | | | Separability*1) | | Separation |
|---|---|---|---|---|---|---|---|---|
| | | | Y | M | C | Area (%) | Position | |
| 101 | — | — | 94 | 92 | 82 | — | — | No |
| 101 | — | — | 80 | 78 | 68 | 50 | In treating solution | Yes |
| 102 | A | — | 90 | 85 | 75 | — | — | No |
| 102 | A | — | 80 | 72 | 61 | 100 | Between 6th and 3rd layers | Yes |
| 103 | B | — | 90 | 86 | 69 | — | — | No |
| 103 | B | — | 80 | 70 | 56 | 100 | Between 6th and 3rd layers | Yes |
| 104 | A | (6) | 94 | 96 | 85 | — | — | No |
| 104 | A | (6) | 90 | 88 | 79 | 100 | Between 6th and 3rd layers | Yes |
| 105 | A | (7) | 94 | 94 | 84 | — | — | No |
| 105 | A | (7) | 91 | 88 | 80 | 100 | Between 6th and 3rd layers | Yes |
| 106 | A | (12) | 94 | 93 | 84 | — | — | No |
| 106 | A | (12) | 91 | 89 | 80 | 100 | Between 6th and 3rd layers | Yes |
| 107 | A | (31) | 94 | 94 | 86 | — | — | No |
| 107 | A | (31) | 91 | 88 | 78 | 100 | Between 6th and 3rd layers | Yes |
| 108 | A | (33) | 94 | 92 | 84 | — | — | No |
| 108 | A | (33) | 91 | 88 | 79 | 100 | Between 2nd and 4th layers | Yes |
| 109 | B | (18) | 94 | 92 | 84 | — | — | No |
| 109 | B | (18) | 91 | 87 | 74 | 100 | Between 2nd and 4th layers | Yes |
| 110 | B | (22) | 94 | 94 | 84 | — | — | No |
| 110 | B | (22) | 91 | 88 | 76 | 100 | Between 2nd and 4th layers | Yes |

*1)A separated sample and an unseparated sample were prepared for every photographic material to evaluate them.
*2)A: The layer constitution described in Table 2; B: The layer constitution described in Table 3

As is apparent from Table 4, in Photographic Material 101 having no separation layer, separation between the protective layer and the cover sheet takes place. Not only is the separation surface dirty, but also the components of the treating solution are left on the separation surface, which results in unfavorable stickiness.

In contrast, Photographic Materials 102 to 110 each having the separation layers are cleanly separated at layers containing the separation layers.

Further, in Photographic Materials 104 to 110 of the present invention containing the hydrazine derivatives in the image receiving layers, the light fastness is largely improved for both the separated and unseparated samples, which reveals that the separability is compatible with the light fastness.

Furthermore, the third layer (the opaque layer) in Table 1 was provided in place of the fifth layer (the separation layer) and the fourth layer (the gelatin layer) in layer constitution A of Table 2, and the 4th to 21st layers in Table 1 were provided thereon to prepare a photographic material. The hydrazine derivatives used in the present invention were added to the first layer (the image receiving layer) of this photographic material, and the separability and the light fastness were evaluated similarly. Similar satisfactory results were obtained.

EXAMPLE 2

Photographic materials were prepared in the same manner as Photographic Material 102, except that hydrazine derivative (10) used in the present invention was added to the first layer (the image receiving layer) of Photographic Material 102 in amounts shown in Table 5, and the light image fastness was determined in accordance with the method described in Example 1, except that the fading test period was 3 weeks. Results are shown in Table 5.

TABLE 5

| Photographic Material | Amount Added ($g/m^2$) | Light Fastness (%) Y | M | C | Remarks |
|---|---|---|---|---|---|
| 201 | 1.00 | 74 | 65 | 54 | Invention |
| 202 | 1.50 | 86 | 77 | 70 | Invention |
| 203 | 3.00 | 88 | 80 | 72 | Invention |
| 204 | 6.00 | 90 | 84 | 74 | Invention |
| 205 | 9.00 | 91 | 86 | 76 | Invention |
| 206 | — | 70 | 61 | 49 | Comparison |

As is apparent from Table 5, light fastness is improved by addition of the hydrazine derivative used in the present invention, and it is effective to add the hydrazine derivative in an amount of 1.50 $g/m^2$ ($4.6\times10^{-3}$ $mol/m^2$) to 6.00 $g/m^2$ ($1.8\times10^{-2}$ $mol/m^2$).

According to the present invention, separability and light image fastness are improved.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic film unit comprising (1) a light sensitive sheet comprising an image receiving layer, a white reflective layer, a shading layer and at least one silver halide emulsion layer having at least one dye image forming substance, which layers are formed on a transparent support, (2) a transparent cover sheet comprising a neutralization layer and a neutralization timing layer, which layers are formed on a transparent support, and (3) a shading alkali treating composition developed between said light sensitive sheet and said transparent cover sheet, in which the image receiving layer contains a hydrazine derivative in an amount of 1.50 $g/m^2$ to 6.00 $g/m^2$ represented by the following general formula (I):

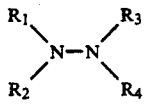

(I)

wherein $R_1$, $R_2$, $R_3$ and $R_4$ each independently represents an alkyl group having 1 to 24 carbon atoms and may combine with one another to form a ring, provided that said ring is non-aromatic heterocyclic group and that all atoms belonging to $R_1$, $R_2$, $R_3$ and $R_4$ and constituting the ring are carbon atoms, wherein one or more of $R_1$, $R_2$, $R_3$ and $R_4$ is substituted by a hydroxyl group, a sulfonic acid group of a salt thereof, or a carboxylic acid group or a salt thereof.

2. The color diffusion transfer photographic film unit as in claim 1, wherein a separation layer is located between the shading layer and the emulsion layer.

3. The color diffusion transfer photographic film unit as in claim 1, wherein a separation layer is located between the white reflective layer and the shading layer.

* * * * *